US005214827A

United States Patent [19]

Yamanishi

[11] Patent Number: 5,214,827

[45] Date of Patent: Jun. 1, 1993

[54] SEAT BELT TONGUE

[75] Inventor: Takahiro Yamanishi, Shiga, Japan

[73] Assignee: Takata Corporation, Tokyo, Japan

[21] Appl. No.: 912,194

[22] Filed: Jul. 13, 1992

[30] Foreign Application Priority Data

Jul. 19, 1991 [JP] Japan ..... 3-179370

[51] Int. Cl.[5] ..... A44B 11/26

[52] U.S. Cl. ..... 24/628

[58] Field of Search ..... 24/633, 628, 573.5; 297/468, 483

[56] References Cited

U.S. PATENT DOCUMENTS 3,606,454 9/1971 Dorn ..... 297/483 X 3,897,611 8/1975 Booth et al. ..... 24/628

4,606,552 8/1986 Hultqvist ..... 24/628 X

*Primary Examiner*—James R. Brittain

*Attorney, Agent, or Firm*—Kanesaka and Takeuchi

[57] ABSTRACT

A seat belt tongue comprises a tongue projection to be inserted from a front end thereof into a buckle, a wrap portion provided at a rear end of the tongue projection for receiving the belt, and a cover, made of at least one of synthetic resin and rubber, covering at least a front end of the tongue projection, the cover being capable of taking a covering position covering the front end of the tongue projection and a retracted position exposing the front end of the tongue projection.

4 Claims, 6 Drawing Sheets

SEAT BELT TONGUE

BACKGROUND OF THE INVENTION

The present invention relates to a seat belt tongue which has a tongue projection consisting of a tongue plate etc., and more particularly it relates to the tongue having a cover which covers at least a front end of the tongue projection.

A seat belt device is mounted in a vehicle for restraining a vehicle occupant. As shown in FIG. 7, a seat belt has a belt 4 which is withdrawn from a retractor 2, provided in the vehicle. The belt 4 passes through an opening of a tongue 10 which is accepted and secured by a buckle 6. This buckle 6 is disposed on one side of a vehicle seat 8 and fixed to a vehicle's body. The forms of known tongue will be explained referring to FIGS. 5 and 6.

The tongue 10 shown in FIG. 5 has at its rear end a wrap portion 12 having an opening, through which a seat belt is wrapped. The portion 12 is integral with a tongue plate 14 of the tongue 10. In this tongue plate 14 there is provided a latch opening 16 which engages with a latch device of a buckle.

A tongue 18 shown in FIG. 6, has a wrap portion 12 which is integral with a rod-shaped tongue projection 20 provided with a circumferential latch groove 22 at its front portion.

The tongues 10 and 18 are made of metal which is extremely hard. Therefore, the tongue sometimes hits window glass of a vehicle to make a loud noise when the tongue is removed from the buckle and the belt is withdrawn by a retractor.

SUMMARY OF THE INVENTION

It is an object of the present invention to provide a seat belt tongue which produces an extremely small noise when it hits window glass of a vehicle.

According to a first form of the invention, there is provided a seat belt tongue comprising: a tongue projection to be inserted from its front end into a buckle; a wrap portion provided at a base end of the tongue projection for receiving the seat belt; and a cover, made of synthetic resin or of rubber, covering at least a front end of the tongue projection. The cover can take a covering position covering the front end of the tongue projection and a retracted position exposing the front end of the tongue projection.

According to a second form of the invention, there is provided a seat belt tongue of the first form, in which the cover comprises a fixed cover member fixed to the base end of the tongue projection, and a movable cover member supported in a freely moving manner by the fixed cover member so that the movable cover member can take an advanced position covering the front end of the tongue projection and a retracted position exposing the front end of the tongue projection.

According to a third form of the invention, there is provided a seat belt tongue of the second form, in which the movable cover member comprises a first movable cover member sliding freely on the fixed cover member, and a second movable cover member sliding freely on the first movable cover member.

According to a fourth form of the invention, there is provided a seat belt tongue of the second form, in which the movable cover member has a biasing member which biases the movable cover member in the direction of a position in which the movable cover member covers the tongue projection's front end.

According to a fifth form of the invention, there is provided a seat belt tongue according of the fourth form, in which a front end of the movable cover member is of a tapering shape.

The tongue projection of the first form of the seat belt tongue is covered with the cover made of synthetic resin or of rubber, and therefore very small sound is produced in the event that the tongue hits window glass of a vehicle.

The seat belt tongue of the second form has the cover consisting of the fixed cover member and the movable cover member, and the movable cover member can be retracted, so that the tongue projection is exposed and can be put into the buckle.

The seat belt tongue of the third form has the movable cover member consisting of the first movable cover member and the second movable cover member, and therefore the length of stroke of the movable cover member is great. Therefore the tongue projection is sufficiently exposed and so it can be put easily into the buckle.

In the seat belt tongue of the fourth form, because the movable cover member is biased by the biasing member, the front end of the tongue projection is reliably covered by the cover when force is not being applied to the movable cover member.

In the seat belt tongue of the fifth form, when it is intended to be joined to the buckle, first the front end of the movable cover member makes contact with the buckle. Because the front end of the movable cover member is tapering, the movable cover member engages with the buckle's inlet portion fitly whereby the tongue projection is inserted into the buckle smoothly.

DESCRIPTION OF THE PREFERRED EMBODIMENT

Figure 1:
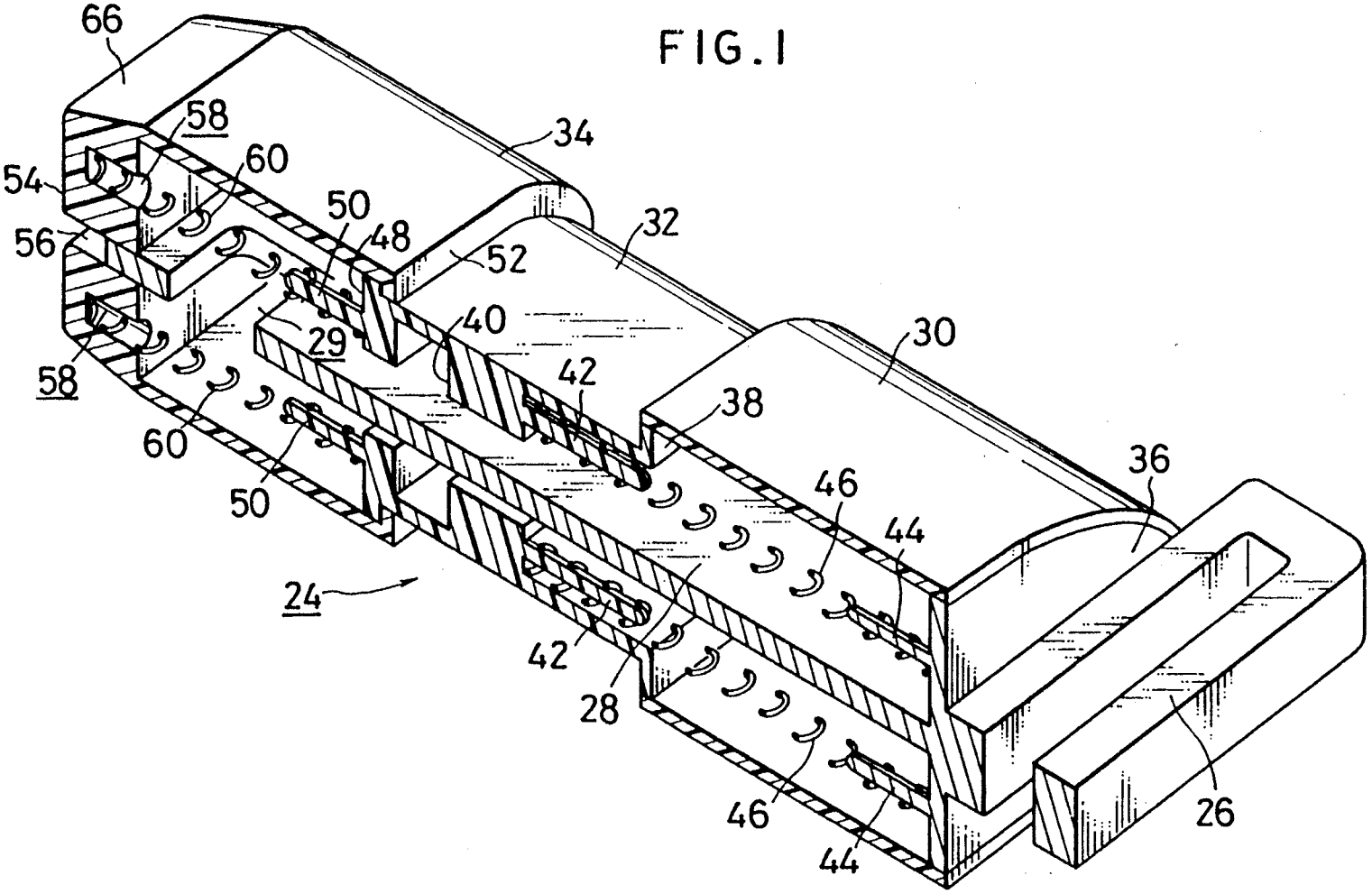
FIG. 1 is a sectional view of a tongue embodying the present invention.

An embodiment of the invention will now be explained referring to the figures.

A seat belt tongue 24 shown in FIGS. 1 through 4 has a wrap portion 26 and a tongue plate 28 which are made of metal and integral with each other. A latch opening 29 is provided at the front end of the tongue plate 28. The tongue plate 28 is covered with a fixed cover member 30, a first movable cover member 32 and a second movable cover member 34. These cover members 30, 32 and 34 are approximately elliptical in cross-section, and in this embodiment are made of synthetic resin, but they can also be made of rubber. A further possibility is to make a cover member mainly of synthetic resin and to provide rubber on the outer surface of the cover.

The fixed cover member 30 is fitted on a periphery of a flange 36 which is provided at a rear end of the tongue plate 28, and fixed to the flange 36 by, for example, adhesion. The first movable cover member 32 has a diameter smaller than the fixed cover member 30 so that it can go inside fixed cover member 30. A flange 38 is provided at a rear end of the first movable cover member 32 extending outwards from the first movable cover member 32 such that the outer circumferential surface of the flange 38 slides freely on the inner circumferential surface of the fixed cover member 30. A flange 40 is projected on the inner circumferential surface of the first movable cover member 32, and a projection 42 is provided on the rear surface of the flange 40, extending parallel to the tongue plate 28. In a position facing this projection 42, a projection 44 is provided on the flange 36, and a coil spring 46 is loaded between these projections 42 and 44.

A flange 48 is provided on the front end of the first movable cover member 32, and a projection 50 is provided on the front surface of the flange 48, extending parallel to the tongue plate 28.

The second movable cover member 34 is provided such that the circumferential surface thereof slides freely on the outer circumferential surface of the flange 48. A wall 52 is provided project inwards at the rear end of the second movable cover member 34. Since the wall 52 makes contact with the flange 48, the second movable cover member 34 is prevented from being withdrawn from the first movable cover member 32. The first movable cover member 32 and the fixed cover member 30 are also prevented from coming apart from each other by the provision of a structure of the same kind, but this is not illustrated.

A cap 54 is provided at the front end of the second movable cover member 34. The cap 54 has at its center portion an opening 56 to allow the tongue plate 28 to pass therethrough.

In the inner surface of the cap 54 a cavity 58 is provided. One end of a coil spring 60 is inserted into the cavity 58. The other end of the coil spring 60 is engaged with the projection 50.

When no force is being applied to the movable cover members 32 and 34 of the tongue 24, the movable cover members 32 and 34 are at the forward limit of their travel as shown in FIG. 1 because they are biased by the coil springs 46 and 60, so that the front end of the tongue plate 28 is entirely covered by the cover members 32 and 34.

Figure 2:
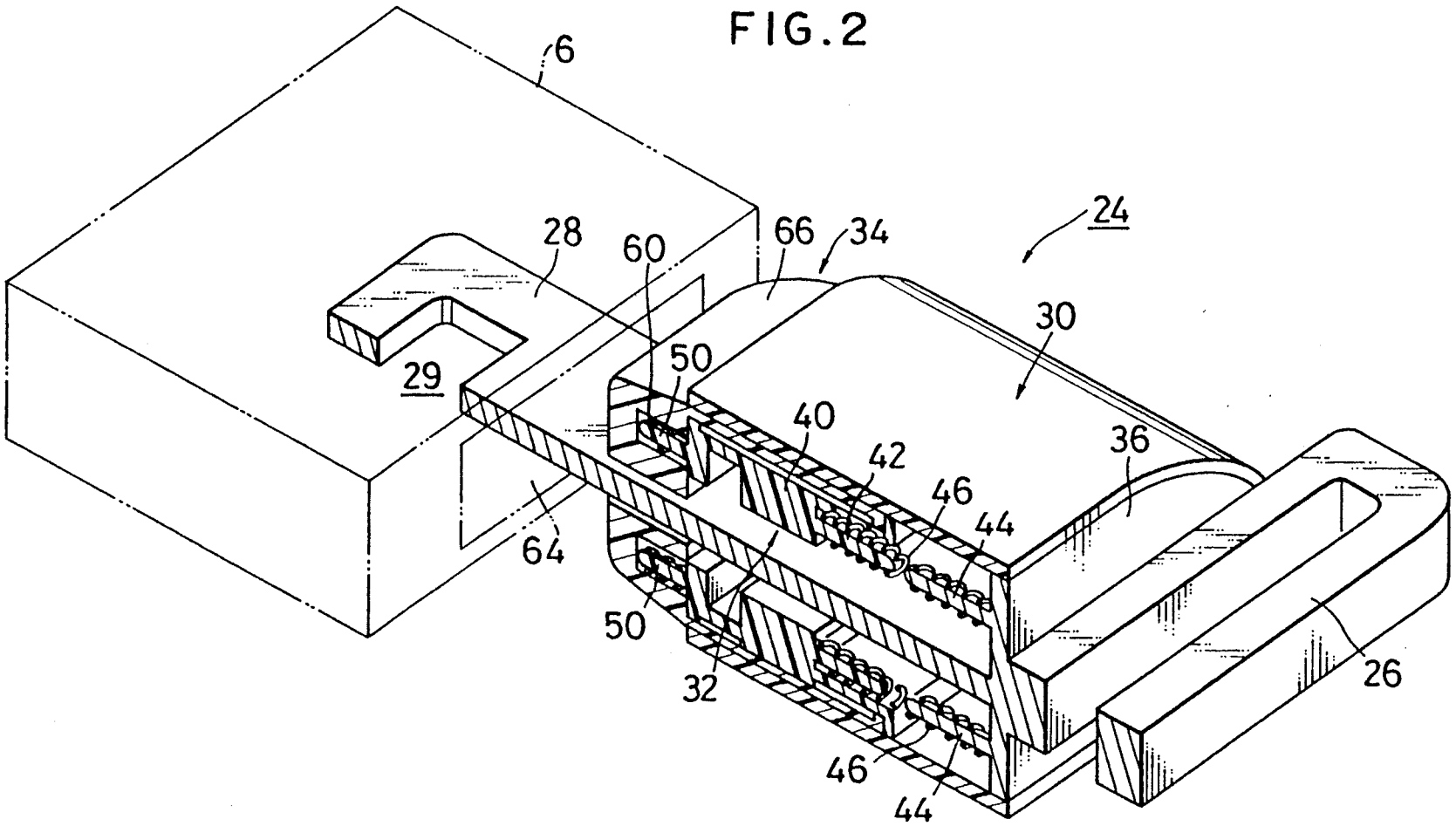
FIG. 2 is a sectional view of a tongue embodying the present invention in use.
Figure 3:
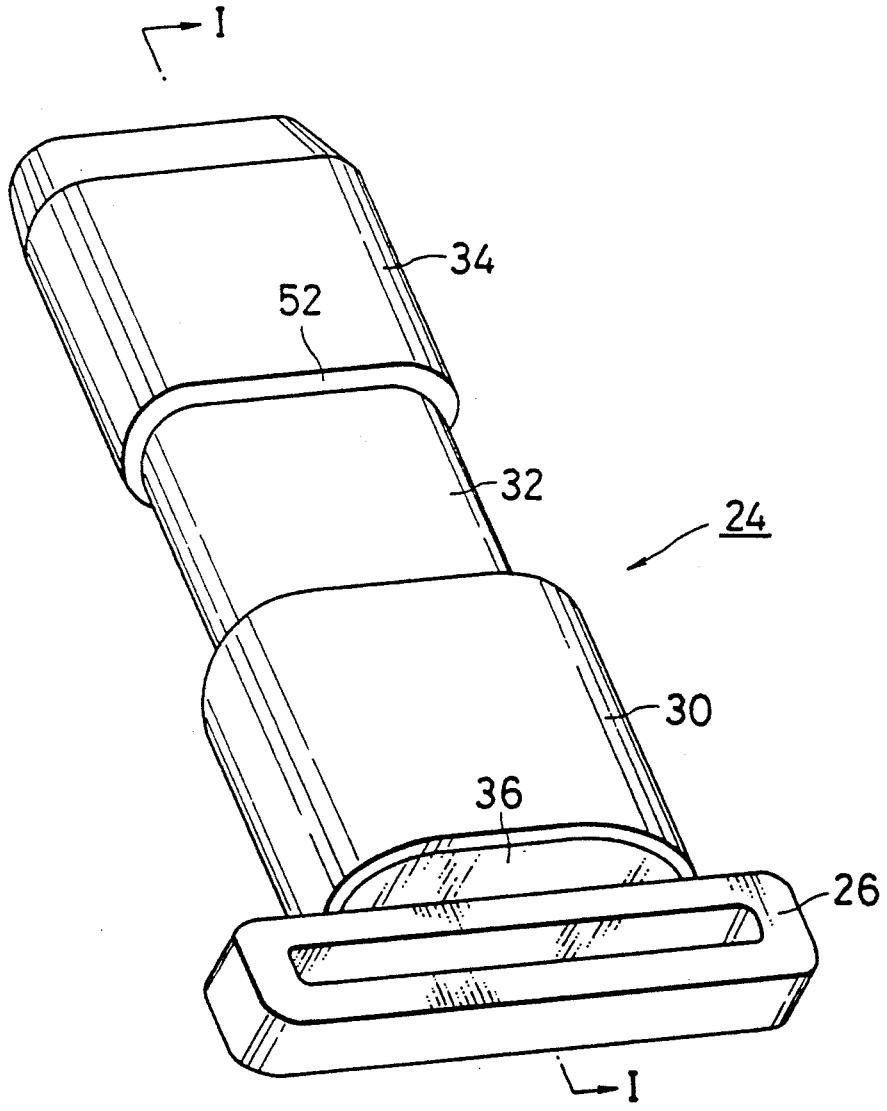
FIG. 3 is a perspective view of a tongue embodying the present invention.
Figure 4:
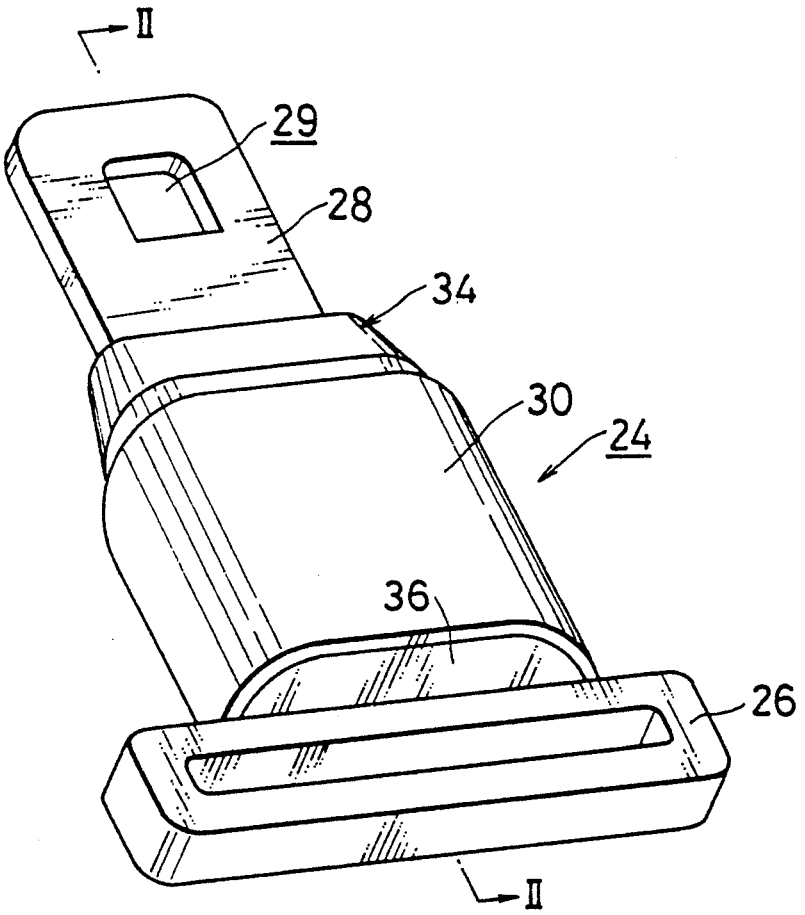
FIG. 4 is a perspective view of a tongue embodying the present invention in use.
Figure 5:
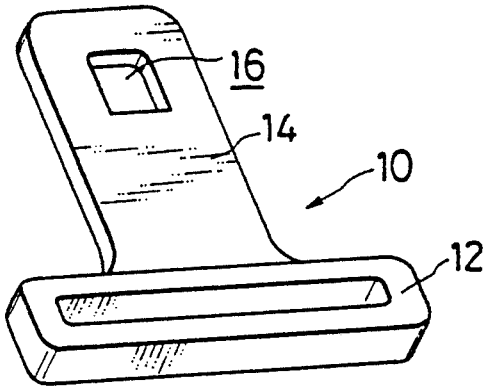
FIG. 5 PRIOR ART
FIG. 5 is a perspective view of a known tongue.

When a force is applied to the movable cover members 32 and 34 in a rearward direction (rightward direction in FIG. 1), the front end of the tongue plate 28 is exposed through the opening 56 as shown in FIG. 2. In this exposed state, the tongue plate 28 is engaged with the buckle 6 through an inlet 64 of the buckle 6.

To engage the tongue 24 with the buckle 6, the occupant is required only to fit the front end of the tongue 24 (that is the front end of the second movable cover member 34) to the inlet 64 and to insert the tongue 24 into buckle 6. In other words, when an occupant pushes the tongue 24, the movable cover members 32 and 34 retreat, and only the tongue plate 28 is inserted through the inlet 64, and finally the latch opening 29 engages with the latch device to lock the tongue 24 to the buckle 6.

It should be noted that, as shown in FIG. 1, according to the above embodiment the front end of the second movable cover member 34 has a tapered surface 66 which tapers. As the center of the inlet 64 meet the center of the tongue plate 28 when they are in contact with each other the tongue plate 28 is inserted smoothly into the inlet 64. Therefore it becomes an extremely simple matter to join the tongue 24 and the buckle 6.

Figure 6:
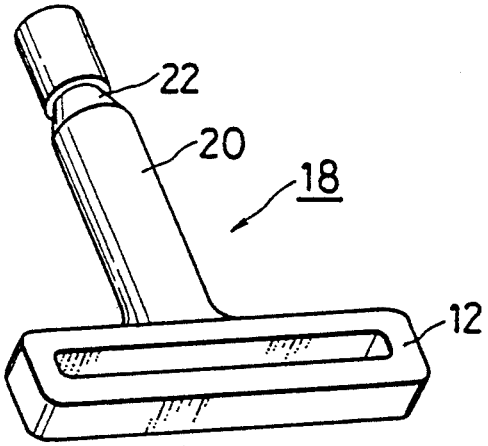
FIG. 6 PRIOR ART
FIG. 6 is a perspective view of another known tongue.
Figure 7:
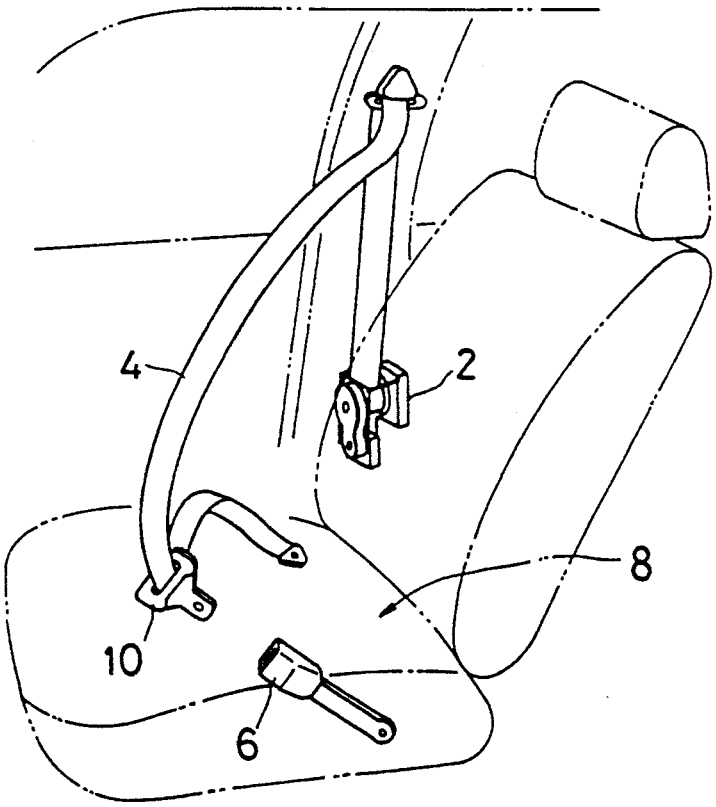
FIG. 7 PRIOR ART
FIG. 7 is a perspective view of a seat belt.

In the above embodiment, the tongue 24 has a tongue plate 28, but according to the present invention the same type of cover can be provided in the case of a tongue 18 having a rod-shaped tongue projection 20 as shown in FIG. 6.

What is claimed is:

1. A seat belt tongue comprising:

a tongue projection having a front end adapted to be inserted into a buckle and a rear end;

a wrap portion provided at the rear end of the tongue projection for receiving a belt; and a cover for covering the tongue projection, said cover being made of at least one of synthetic resin and rubber and having a covering position for covering the front end of the tongue projection and a retracted position for exposing the front end of the tongue projection, said cover including a fixed cover member fixed to a rear portion of the tongue projection, a first movable cover member freely slidably attached to the fixed cover member, and a second movable cover member freely slidably situated over the first movable cover member, said first and second movable cover members taking the covering position for covering the front end of the tongue projection when advanced and the retracted position for exposing the front end of the tongue projection when retracted.

2. A seat belt tongue according to claim 1, in which said movable cover members have biasing members which bias said movable cover members in the direction to cover the front end of the tongue projection so that when force is not being applied from outside, the movable cover members advance to forward limit of advance ad the front end of the tongue plate is covered by said cover.

3. A seat belt tongue according to claim 1, in which an outside surface of a front end of said second movable cover member is of a tapering shape, so that when the front end of the second movable cover member is made contact with a tongue inlet of the buckle, a center of said inlet meets a center of the tongue projection so that said tongue projection is inserted smoothly into the buckle through said inlet.

4. A seat belt tongue according to claim 1, in which said second movable cover member is situated outside the first movable cover member so that when the first and second movable cover members are fully retracted, the second movable cover member basically positioned between the fixed cover member and the first movable cover member.

* * * * *